US010756436B2

(12) United States Patent
Tekin et al.

(10) Patent No.: US 10,756,436 B2
(45) Date of Patent: Aug. 25, 2020

(54) DOUBLE-DIFFERENTIAL FED, DUAL POLARIZED PATCH ANTENNA SYSTEM WITH ADVANCED INTERPORT RF ISOLATION FOR IBFD TRANSCEIVERS

(71) Applicant: Sabanci Universitesi, Istanbul (TR)

(72) Inventors: Ibrahim Tekin, Istanbul (TR); Haq Nawaz, Istanbul (TR)

(73) Assignee: Sabanci Universitesi, Istanbul (TR)

( * ) Notice: Subject to any disclaimer, the term of this patent is extended or adjusted under 35 U.S.C. 154(b) by 63 days.

(21) Appl. No.: 16/258,237

(22) Filed: Jan. 25, 2019

(65) Prior Publication Data

US 2020/0127379 A1 Apr. 23, 2020

Related U.S. Application Data

(60) Provisional application No. 62/747,373, filed on Oct. 18, 2018.

(51) Int. Cl.
*H01Q 9/04* (2006.01)

(52) U.S. Cl.
CPC ..... *H01Q 9/0407* (2013.01)

(58) Field of Classification Search
CPC .. H01Q 9/0407; H01Q 9/0464; H01Q 9/0478; H01Q 9/065; H01Q 9/045;
(Continued)

(56) References Cited

U.S. PATENT DOCUMENTS 5,231,407 A * 7/1993 McGirr ..... H01Q 1/243 343/700 MS
9,413,516 B2 * 8/2016 Khandani ..... H04B 1/525
(Continued)

FOREIGN PATENT DOCUMENTS

CN 104993240 A 10/2015
CN 1078909008 A 3/2018

OTHER PUBLICATIONS

Marašević, J., et al., "Resource Allocation and Rate Gaines in Practical Full-Duplex Systems," dated Jun. 15, 2015, pp. 1-14, *SIGMETRICS '15*, Jun. 15-19, 2015, Portland, OR, USA. ACM 978-1-4503-3486-0/15/06.
(Continued)

*Primary Examiner* — Haissa Philogene
(74) *Attorney, Agent, or Firm* — Brinks Gilson & Lione

(57) ABSTRACT

A system may include a double differential-fed dual-polarized 2.4 GHz, microstrip patch antenna with extremely high interport isolation for shared antenna architecture based in-band full duplex (IBFD) transceivers. The presented antenna configuration is based on four ports linearly polarized single radiating element with differential feeding for both transmit (Tx) and receive (Rx) operation. The double differential feeding using two identical 3 dB/180° ring hybrid couplers with nice amplitude/phase balance effectively suppresses the interport RF leakage to achieve very high isolation. Strong amplitude and phase balance of 3 dB/180° ring hybrid coupler can provide a better SIC performance as compared to DFN based on Wilkinson power divider with un-equal length microstrip lines, thus supplying an elite level of suppression in means of self-interference at Tx.

10 Claims, 2 Drawing Sheets

(58) Field of Classification Search
CPC ..... H01Q 1/24; H01Q 1/243; H01Q 1/52; H01Q 1/525; H04B 1/06; H04B 1/58; H04B 1/525; H04L 5/14; H04L 5/1461; H04J 11/003; H04J 11/0036
See application file for complete search history.

(56) References Cited

U.S. PATENT DOCUMENTS

| | | | | |
|---|---|---|---|---|
| 9,571,205 | B1 * | 2/2017 | Suarez | G02F 2/002 |
| 9,941,598 | B2 | 4/2018 | Suh et al. | |
| 10,003,123 | B2 | 6/2018 | Zhang et al. | |
| 10,090,585 | B2 * | 10/2018 | Dinc | H04B 1/06 |
| 10,439,287 | B2 * | 10/2019 | Ashrafi | H01Q 25/04 |
| 2016/0373234 | A1 | 12/2016 | Ju et al. | |
| 2020/0099504 | A1 * | 3/2020 | Erricolo | H04B 1/58 |

OTHER PUBLICATIONS

Sabharwal, A., et al., "In-Band Full-Duplex Wireless: Challenges and Opportunities," dated May 20, 2014, pp. 1-22, arXiv:1311.0456v3 [cs.IT].
Hong, S., et al., "Applications of Self-Interference Cancellation in 5G and Beyond," dated Feb. 2014, pp. 114-121, IEEE Communications Magazine.
Riihonen, T. et al., "On the Prospects of Full-Duplex Military Radios," dated Mar. 31, 2017, pp. 1-6, 978-1-5386-3858-3/17/, © 2017 IEEE.
Korpi, D., et al., "Full-Duplex Transceiver System Calculations: Analysis of ADC and Linearity Challenges," dated Aug. 4, 2014, pp. 1-16, IEEE Transactions on Wireless Communications, arXiv:1401.3538v3 [cs.IT].
Zhang, Z., et al., "Full Duplex Techniques for 5G Networks: Self-Interference Cancellation, Protocol Design, and Relay Selection," dated May 2015, pp. 128-137, 0163-6804/15/, IEEE Communications Magazine.
Bharadia, D., et al., "Full Duplex Radios," dated Aug. 12, 2013, pp. 1-12, *SIGCOMM '13*, Aug. 12-16, 2013, Hong Kong, China, ACM 978-1-4503-2056-6/13/08.
Sim, C.Y.D, et al., "Dual-Feed Dual-Polarized Patch Antenna with Low Cross Polarization and High Isolation," dated Oct. 7, 2009, pp. 3321-3324, IEEE Transactions on Antennas and Propagation, vol. 57, No. 10, Oct. 2009.
Lin, X-J, et al., "High Isolation Dual-Polarized Patch Antenna with Hybrid Ring Feeding," dated May 3, 2017, pp. 1-7, Research Article, Hindawi, International Journal of Antennas and Propagation, vol. 2017, Article ID 6193102, 6 pgs., https://doi.org/10.1155/2017/6193102.
Debaillie, B., et al., "Analog/RF Solutions Enabling Compact Full-Duplex Radios," dated Jun. 12, 2014, pp. 1662-1673, IEEE Journal on Selected Areas in Communications, vol. 32, No. 9, Sep. 2014, Digital Object Identifier code: 11.1109/JSAC.2014.2330171.
Luo, K., et al., "Design of Dual-Feed Dual-Polarized Micro-Strip Antenna with High Isolation and Low Cross Polarization," dated Nov. 12, 2012, pp. 1-10, Progress in Electromagnetics Research Letters, vol. 36, 31-40, 2013.
Nawaz, H., Tekin, I., "Compact dual-polarised microstrip patch antenna with high interport isolation for 2.5 GHz in-band full-duplex wireless applications," dated Jan. 12, 2017, pp. 976-981, IET Microw. Antennas Propag., 2017, vol. 11, Iss 7, The Institution of Engineering and Technology (IET) Journals, ISSN 1751-8725.

* cited by examiner

DOUBLE-DIFFERENTIAL FED, DUAL POLARIZED PATCH ANTENNA SYSTEM WITH ADVANCED INTERPORT RF ISOLATION FOR IBFD TRANSCEIVERS

PRIORITY

The present application claims priority under 35 U.S.C. § 119(e) to U.S. Provisional Application No. 62/747,373, filed Oct. 18, 2018, the entire contents of which are hereby incorporated by reference.

TECHNICAL FIELD

The disclosure relates to a system that includes a patch antenna that is dual-polarized and double-differential fed, displaying very high levels of radio-frequency (RF) isolation between ports thereof, in the general context of in-band full duplex (IBFD) transceivers and self-interference cancellation (SIC) applications pertaining to facilitation thereof.

BACKGROUND

Up-and-coming 5G systems pose great challenges in means of existing systems and further improvement thereof are categorized in terms of focused "key performance indicators" (KPIs), among them peak data rate, spectral efficiency, end-to-end latency, connection density. Key technologies in forward 5G framework include massive multi-input-multi-output (MIMO), ultra-dense networks, all-spectrum access, new network architectures and in-band full duplex (IBFD) communication. Since only half of the physical bandwidth is available in one-way wireless communication, full-duplex systems have been rendered possible in that it doubles the spectral efficiency. As a corollary ahead of the traditional time and frequency division multiplexing, same carrier frequency serves as base for transmitting and receiving signals which also addresses issues such as hidden terminal and throughput degradation caused by large network delays.

SUMMARY

Realization of in-band full duplex (IBFD) wireless operation relies on the efficient and effective cancellation or suppression of self-interference (SI) signal at the receive side which is caused by strong RF leakage between transmit (Tx) and receive (Rx) chains of the same transceiver, interfering with very weak receive signals of interest. To overcome this problem, self-interference cancellation is required, amount of which depends on the application and transmit power in addition to bandwidth and noise figure of receive end.

Most of the efforts on SI cancellation are deployed at antenna level, RF/analog level and digital baseband levels, none of which are by themselves only capable of providing required high amount of isolation between Tx and Rx chains.

In a study titled "Dual-Feed Dual-Polarized Patch Antenna with Low Cross Polarization and High Isolation" by C. C. Chang et al. published in IEEE Transactions on Antennas and Propagation (Volume: 57, Issue: 10, October 2009), a two-ports dual-polarized patch antenna is proposed that deploys a power divider with two meandering strips with 180° phase difference as differential feeding network (DFN) to attain an interport isolation level of 40 dB in 14% impedance bandwidth. Another study titled "High Isolation Dual-Polarized Patch Antenna with Hybrid Ring Feeding" by X. J. Lin et al. published in International Journal of Antennas and Propagation (Volume 2017) proposes a multilayered dual-polarized patch antenna utilizing hybrid ring feeding to achieve a level of interport isolation greater than 40 dB for 1.875-2.737 GHz bandwidth. A Wilkinson power divider with unequal length microstrip lines for 180° phase difference is used in the study "Analog/RF Solutions Enabling Compact Full-Duplex Radios" published in IEEE Journal on Selected Areas in Communications (Volume: 32, Issue: 9, September 2014) by Debaillie et al. to differentially excite the two slot-coupled ports, free space measurements for which provide about 60 dB peak isolation and 55 dB peak isolation for 10 MHz bandwidth. Study titled "Design of Dual-feed Dual-polarized Microstrip Antenna with High Isolation and Low Cross Polarization" by Luo et al. in Progress in Electromagnetics Research Letters (Vol. 36, 2013) teaches a pair of L-shaped probes with 180° phase differences for DFN for one mode, and H-shaped slot for second polarization, for achieving a minimum of 40 dB interport isolation over a wider bandwidth, albeit it suffers a back-lobe radiation from a slotted ground plane as a characteristic of slot-coupled DFN.

Amplitude and phase balance of 3 dB/180° ring hybrid coupler can provide a better self-interference cancellation (SIC) performance as compared to DFN based on Wilkinson power divider with unequal strip lines. In the work by Nawaz and Tekin titled "Compact dual-polarized microstrip patch antenna with high interport isolation for 2.5 GHz in-band full-duplex wireless applications" published in IET Microwaves, Antennas & Propagation (Volume: 11, Issue: 7, Jun. 2, 2017) the ring hybrid coupler achieves self-interference cancellation over a wide frequency range, with the level of isolation achievable is limited by strong RF coupling between closely spaced feed lines placed on the identical edge of a radiating patch ever so.

U.S. Pat. No. 9,941,598, teaches an in-band full-duplex wireless communication operation scheme, more particularly, a setting that utilizes a complementary pair of antennas for signal transmission and reception arranged in a manner to provide an extremely high (e.g., 60 dB or more) isolation. US 2016373234 discloses an in-band full duplex transceiver, including a multi-polarized antenna including a plurality of polarized transmitting/receiving units and a plurality of transmitting/receiving modules. Said modules further have an analog circuit unit including a FIR filter that converts an analog Rx signal received through the corresponding polarized transmitting/receiving unit into a digital Rx signal, converts a digital Tx signal into an analog Tx signal, and uses the analog Tx signal to cancel self-interference from the analog Rx signal; and a distributor transmitting the analog Rx signal input from the corresponding polarized transmitting/receiving unit to the analog circuit unit and transmitting the analog Tx signal input from the analog circuit unit to the corresponding polarized transmitting/receiving unit.

CN 107809008 discloses an in-strip full-duplex antenna comprising a square microstrip radiation patch, two T-shaped probes for coupled feeding and a 180-degree hybrid ring feeding network. The antenna has an in-strip full-duplex function, and the transmitting and receiving processes of the antenna are simultaneously performed and occupy the same working frequency band.

CN 104993240 provides a method for improving antenna isolation and an antenna which is characterized by feeding an in-phase signal and an anti-phase signal in antenna radiators at the same time, thus differential-mode radiation and common-mode radiation generated in the antenna radiators at the same time can achieve improvement of the antenna isolation. The antenna comprises antenna radiators, a mode separating drive circuit, a first radiation feed source and a second radiation feed source; wherein one end of the first radiation feed source is connected with the mode separating drive circuit, the other end of the first radiation feed source is grounded; one end of the second radiation feed source is connected with the mode separating drive circuit, the other end of the second radiation feed source is grounded; the mode separating drive circuit is also connected with the antenna radiators; the mode separating drive circuit enables an electric signal of the first radiation feed source to be inputted into the antenna radiators in the form of in-phase signal, so as to generate common-mode radiation; and the mode separating drive circuit simultaneously enables an electric signal of the second radiation feed source to be inputted into the antenna radiators in the form of anti-phase signal, so as to generate differential-mode radiation.

U.S. Pat. No. 10,003,123 discloses a full-duplex antenna comprising an omnidirectional receive antenna and two, directional transmit antennas, first of which is disposed on one side of the receive antenna reverse direction of a main lobe of a radiation pattern of which points to the receive antenna; and the second of which is disposed on the other side of the receive antenna. A distance between said second transmit antenna and the receive antenna is equal to a distance between the first transmit antenna and the receive antenna. The second transmit antenna is a directional antenna, and a reverse direction of a main lobe of a radiation pattern of the second transmit antenna points to the receive antenna According to the present system, differential excitation of an antenna is elaborated in the case where a dual-polarized, dual-differential 2.4 GHz microstrip patch antenna is based on four ports and 3 dB/180-degree hybrid coupling which intrinsically carry desirable amplitude and phase balance characteristics.

An interesting feature of the system is to provide a patch antenna for dual-polarized in band full duplex transceivers.

Another interesting feature of the system is to provide a patch antenna for double-differential fed dual-polarized in band full duplex transceivers.

Yet another interesting feature of the system is to provide double-differential fed dual-polarized patch antenna element with an elite self-interference cancelling profile.

A further interesting feature of the system is to provide a double-differential fed dual polarized patch antenna element with 90 dB interport RF isolation capability.

A still further interesting feature of the system is to provide a double-differential fed dual polarized patch antenna that improves the front-end port-2-port isolation on a level of 90 dB and 80 dB at 20 and 40 MHz bandwidths respectively, resulting in practical alleviation of the RF leakage problem.

The disclosed system may include a double-differential fed dual polarized in-band full duplex (IBFD) antenna with a single radiating element as transceiver for enhanced spectral efficiency as well as greatly mitigated self-interference (SI) problem. The main strength of the full-duplex transceiver proposed hereby lies in its strong front-end suppression and therefore, due to compactness and readiness in implementation on up-and-coming 5G equipment, as a corollary also relieves strain on remaining parts of interface to produce/sustain an acceptable signal-to-noise ratio (SNR) such as radio frequency (RF) analog cancellation and digital cancellation, purported state-of-the-art procedures setting the bar at approximately 40 dB each.

The double-differential fed dual polarized in-band full duplex (IBFD) antenna with a single radiating element of four ports as transceiver provides an elite grade of antenna-level cancellation/suppression, at a level of 90 and 80 dB in 20 and 40 MHz bandwidths in comparison to radiating patch-employing in-band full duplex antennas known in the art.

The disclosure therefore broadly relates to a method of and system to attain antenna isolation level enhancement for in-band full duplex transceivers for greatly increasing the bandwidth efficiency prospects for performance of by removing any need for analog cancellation.

According to the disclosed system, an in-band full duplex (IBFD) antenna having double-differential feeding and dual polarization is proposed wherein, in the threefold overcoming of self-interference problem in in-band full duplex (IBFD) communications, antenna stage cancellation/mitigation namely arising from the novel physical structural properties for interport isolation is taught, context wherein transmitter power level in decibel-milliwatts (dBm) at the receiver side, from peak 25 to the noise floor of −85, 80 dB cancellation of which is achievable and delivering the rest of the 30 dB cancellation to be delivered to subsequent stages of in-band full duplex (IBFD) antenna modules and elements mainly baseband digital cancellation.

BRIEF DESCRIPTION OF THE FIGURES

Accompanying drawings are given solely for the purpose of exemplifying a double-differential fed dual-polarized four port patch antenna for high interport isolation in in-band full duplex (IBFD) communication, whose advantages were outlined above and will be explained in brief hereinafter.

The drawings are not meant to delimit the scope of protection as identified in the claims nor should they be referred to alone in an effort to interpret the scope identified in said claims without recourse to the technical disclosure in the description of the present system.

DETAILED DESCRIPTION

Figure 1:
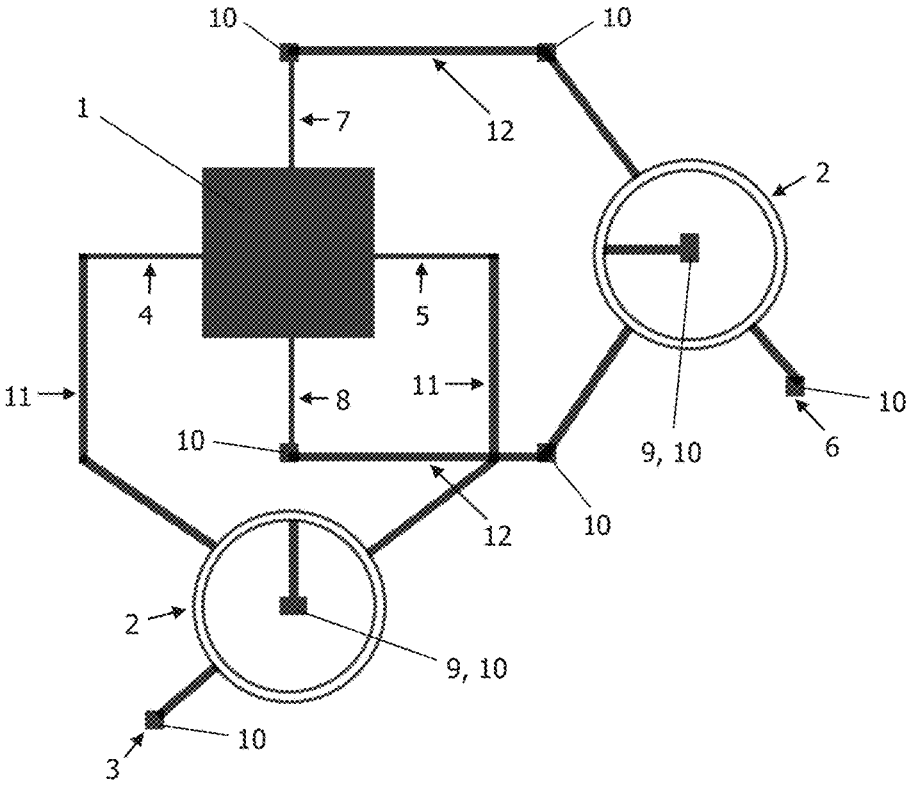
FIG. 1 demonstrates top view of the circuit schematics of the double differential-fed dual-polarized IBFD patch antenna according to one embodiment.
Figure 2:
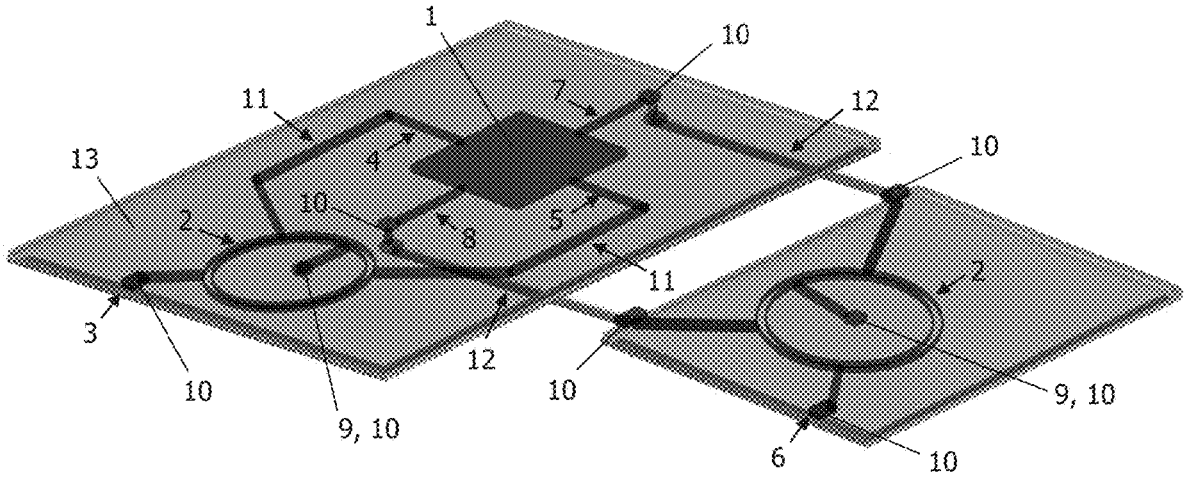
FIG. 2 demonstrates top perspective view of the circuit schematics of the double differential-fed dual-polarized IBFD patch antenna according to one embodiment.
Figure 3:
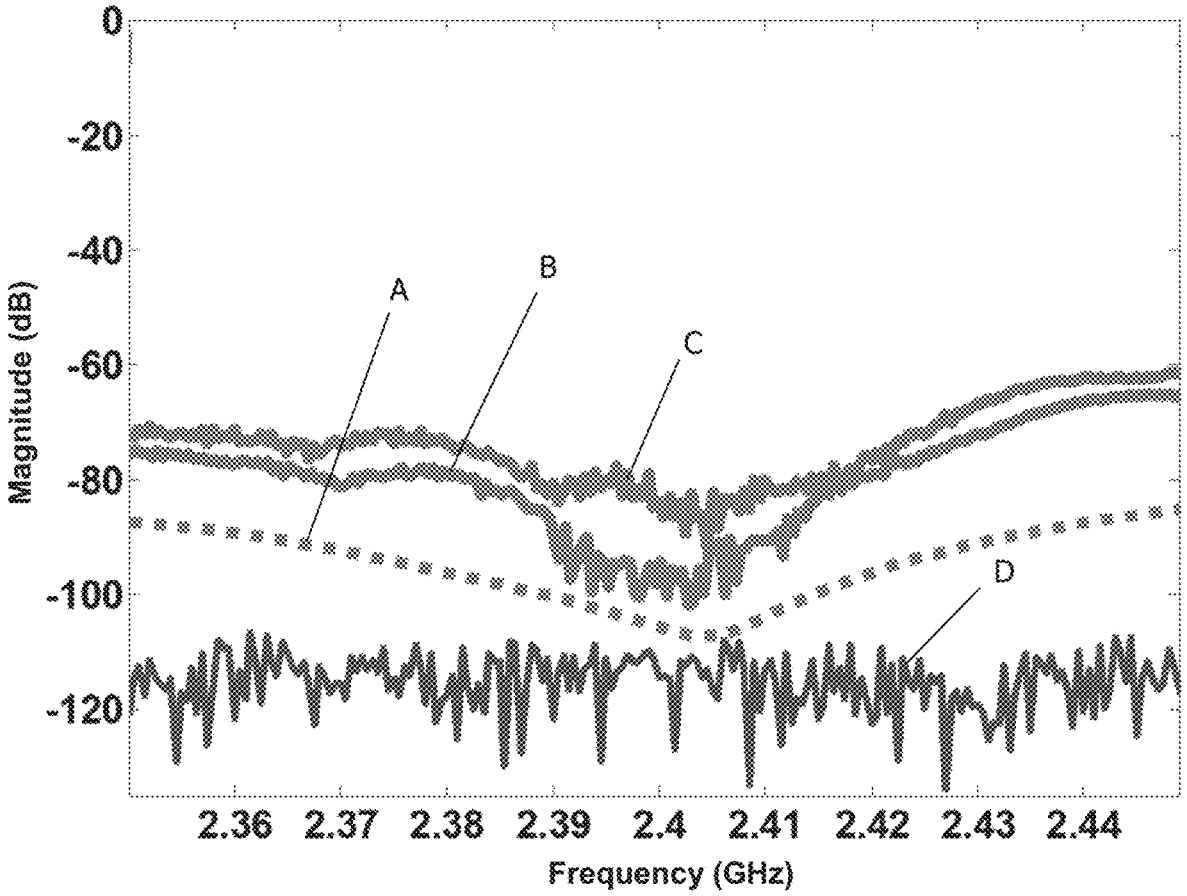
FIG. 3 demonstrates the magnitude (dB) versus bandwidth (GHz) graph representing the simulated and measured interport isolation performances of said double differential-fed dual-polarized IBFD patch antenna according to one embodiment.

1) Patch antenna
2) 3 dB/180° ring hybrid coupler
3) Tx Port
4) Differential port 1
5) Differential port 2
6) Rx Port
7) Differential port 3
8) Differential port 4
9) 50Ω Terminal
10) SMA connector
11) λ/4 microstrip feed line
12) RF cable
13) FR-4 PCB A) Simulation curve
B) Anechoic chamber measurement curve
C) Lab measurement curve
D) VNA noise floor curve With reference to FIGS. 1-3, the present system may include a double differential-fed dual-polarized patch antenna (1) for in-band full duplex (IBFD) transceiver of a single radiating element according to one embodiment for mitigating the detrimental effects of self-interference on the receiving end of transceiver communication in full-duplex communication.

The proposed double differential-fed dual-polarized patch antenna (1) for in-band full duplex (IBFD) transceivers is utilizable in 20 and 40 MHz bandwidths with a performance of 90 and 80 dB self-interference cancellation levels respectively.

The proposed double differential-fed dual-polarized patch antenna (1) for in-band full duplex (IBFD) transceivers is based on a single square shaped radiating patch element comprising four (two pairs) differential ports (4, 5, 7, 8), each of which effectuates the excitation of said patch from centre of respective edges through thin quarter-wave (λ/4) microstrip feed line(s) (11).

The proposed in-band full duplex (IBFD) patch antenna (1) employs differential mechanism for excitation of both Tx and Rx operational modes through pairs of oppositely placed ports, namely differential ports 1 and 2 (4, 5) and differential ports 3 and 4 (7, 8) via 3 dB/180° ring hybrid couplers (2).

The present system is devised under the recognition that albeit full-duplex communication potentially doubles spectral efficiency, structures and architectural features commonly associated therewith bring with them performance problems particularly that of self-interference (SI), which are overcome in traditional wireless systems via utilization of different bands corresponding to Tx and Rx ends of antennas. The present system affords solution of this problem in the manner that the disclosed patch antenna (1) conveys a very high interport isolation level between Tx and Rx ports (3, 6) thereof. A dual polarized patch antenna with an additional self-interference cancellation (SIC) circuit arrives at the elite interport isolation levels, attaining an isolation level of 80 dB in antenna stage only, going to lengths that remove the need for analog cancellation. The relationship between the theoretical simulations and performance measurements can be seen in FIG. 3, x axis of which refers to frequency in GHz and y axis of which refers to magnitude in dB. Dashed line refers to the simulation curve (A) which smoothly posits a peak level of 100 dB isolation, whereas anechoic chamber measurement curve (B) peaks at 98 dB, and lab measurement curve (C) maxes out at ~90 dB. Fluctuant nature of vector network analyzer (VNA) noise curve (D) is also documented.

According to the present disclosure, the bulk of the self-interference cancellation (SIC) is achieved at the antenna stage with the disclosed teaching of double differential-feeding dual polarization using Tx and Rx (3, 6) ports with SMA connectors (10) for signal transmission and reception therethrough, and respective two port pairs.

The single radiating patch antenna (1) resonates at identical Tx and Rx frequencies with linear orthogonal polarization due to the inherent symmetry of the structure and perpendicular placement of Tx and Rx ports (3, 6). The mathematical phasor form representation of linear polarized (LP) electric field vectors (E) for each port excitation are written as shown below:

$$E_{Tx1}=E_r(\hat{y}) \text{ and } E_{Tx3}=E_r(-\hat{y}) \tag{1}$$

$$E_{Rx2}=E_r(\hat{x}) \text{ and } E_{Rx3}=E_r(-\hat{x}) \tag{2}$$

Thus, electric field vectors E for the differentially excited Tx and Rx port (3, 6) modes can be represented as follows:

$$\begin{aligned} E_{Tx} &= E_{Tx1} + e^{j180^\circ} E_{Tx3} \\ &= E_r(\hat{y}) - E_r(-\hat{y}) \\ &= 2E_r(\hat{y}) \end{aligned} \tag{3}$$

$$\begin{aligned} E_{Rx} &= E_{Rx2} + e^{j180^\circ} E_{Rx4} \\ &= E_r(\hat{x}) - E_r(-\hat{x}) \\ &= 2E_r(\hat{x}). \end{aligned} \tag{4}$$

As clear from Equation 3, the differential feeding at Tx port (3) results in constructive interference of radiated fields from said square patch antenna (1). Similarly, both received fields will be combined in phase at Rx port (6) as illustrated in Equation 4. Therefore, the antenna transmits and receives with vertical and horizontal polarizations respectively as follows from above mathematical expressions.

The mathematical expression for RF isolation between Tx and Rx ports (3, 6) of proposed antenna structure shown in FIGS. 1 and 2, is derived mathematically as follows: A total current for Tx port (3) is $I_{Tx}$ and total current for Rx port is $I_{Rx}$ when it is terminated with 50Ω terminals (9) as clearly indicated with reference to FIGS. 1 and 2 for respective ports. Due to differential feeding through 3 dB/180° hybrid coupler (2) at Tx port (3), the current flowing into differential ports 1 and 2 (4, 5) can be expressed as:

$$I_{Tx1} = \frac{I_{Tx}}{\sqrt{2}} \text{ and } I_{Tx3} = \frac{I_{Tx}}{\sqrt{2}} e^{j180^\circ}. \tag{5}$$

Due to interport coupling/leakage between differential ports 1 and 2 (4, 5) of Tx port (3) and differential ports 3 and 4 (7, 8) of Rx port (6), the resultant currents through differential ports 3 and 4 (7, 8) making pair for Rx port (6) are expressed by the following equations:

$$I_{Rx2} = \frac{I_{Tx}}{\sqrt{2}} S_{21} + \frac{I_{Tx}}{\sqrt{2}} e^{j180^\circ} S_{23} = \frac{I_{Tx}}{\sqrt{2}} (S_{21} - S_{23}) \tag{6}$$

$$I_{Rx4} = \frac{I_{Tx}}{\sqrt{2}} S_{41} + \frac{I_{Tx}}{\sqrt{2}} e^{j180^\circ} S_{43} = \frac{I_{Tx}}{\sqrt{2}} (S_{41} - S_{43}). \tag{7}$$

Therefore, the total current $I_{Rx}$ through differential Rx port (6) will be:

$$\begin{aligned} I_{Rx} &= \frac{1}{\sqrt{2}} \left( I_{Rx2} + e^{j180^\circ} I_{Rx4} \right) \\ &= \frac{I_{Tx}}{2} [(S_{21} - S_{23}) - (S_{41} - S_{43})]. \end{aligned} \tag{8}$$

Consequently, Tx-Rx interport coupling/leakage can be given as:

$$\frac{I_{Rx}}{I_{Tx}} = \frac{1}{2} [(S_{21} - S_{23}) - (S_{41} - S_{43})]. \tag{9}$$

Conversely, the radio frequency (RF) isolation between Tx and Rx ports (3, 6) will be:

$$\frac{I_{Tx}}{I_{Rx}} = \frac{2}{(S_{21} - S_{23}) - (S_{41} - S_{43})}. \quad (10)$$

As evidently illustrated in FIGS. 1 and 2, the symmetry of the proposed patch antenna (1) structure provides equal amount of coupling/leakage between any pair of orthogonally placed ports i.e. $S_{21}=S_{23}=S_{41}=S_{43}$. Then, it theoretically follows that the interport radio frequency (RF) isolation will be infinite as given in Equation 10. Practical scrutiny posits that a very high amount of Tx-Rx isolation is achievable through desirable amplitude and phase balance performance of deployed differential feed networks (DFN). Further spawning from Equation 10 is the conclusion that the double differential feed network (DFN) mechanism is very useful to achieve high levels of port-to-port isolation because differential Tx port (3) operation suppresses Tx-Rx leakage at each differential port (7, 8) of Rx port (6) pair and residual self-interference (SI) is further suppressed through second differential feed network (DFN) deployed at Rx port (6). Differential feeding also reduces cross-polarization levels by suppressing self-interference (SI) caused by higher order modes of the radiating patch.

The disclosed system, as briefly mentioned earlier, employs two identical 3 dB/180° ring hybrid couplers (2) for differential excitation of single radiating patch antenna (1) element for Tx and Rx modes preferred due to their good amplitude and port matching performance. Design parameters of said 3 dB/180° ring hybrid couplers (2) are selected so as to comply with 1.6 mm thick FR-4 with $\varepsilon r=4.4$ and tan $\delta=0.02$.

Antenna architecture for IBFD transceiver is realized by etching the patch antenna (1) with four differential ports and Rx port (3) mode-assuming 3 dB/180° ring hybrid coupler (2) on same 1.6 mm thick FR-4 printed circuit board (PCB) (13) with 50Ω inter-connection microstrip transmission lines. Four ports, single square-shaped radiating element (29 mm×29 mm) deploys 19 mm long and 0.8 mm thick quarter-wave (λ/4) microstrip feed lines (11) to excite the patch from each differential port (4, 5, 7, 8). In order to avoid cross-over of 50Ω microstrip transmission lines on single layer FR-4 PCB (13), the Tx port (6) mode-assuming 3 dB/180° ring hybrid coupler (2) has been designed on separate FR-4 PCB (13) to connect it to four ports antenna (1) using phase matched RF cables (12) as shown in FIGS. 1 and 2 The double differential patch antenna (1) is vertically and horizontally polarized for Tx and Rx modes respectively and endorsed by surface currents and pattern orthogonality.

In band full duplex (IBFD) radio transceiver can significantly improve the spectral efficiency through simultaneous transmit and receive (STAR) operation at same carrier frequency as compared to traditional time and frequency division multiplexing. Moreover, IBFD mechanism can resolve various issues in wireless networks like hidden terminal and throughput degradation caused by congestion and large network delays. The IBFD architecture can also be utilized for military radios to accomplish simultaneous jamming and monitoring of RF signals along with reliable inter-node communication capabilities.

The realization of in band full duplex (IBFD) wireless operation relies on the efficient and effective cancellation or suppression of self-interference (SI) signal at receive side which is caused by strong RF leakage between transmit (Tx) and receive (Rx) chains of same transceiver and interferes with comparably very weak received signal of interest (SOI). Normally, this SI signal should be suppressed to receiver's noise floor to prevent the degradation in signal to noise ratio (SNR). An antenna with high interport isolation prevents the saturation of receiver from high power SI signal and also alleviates the SIC requirements on subsequent stages. For example, the IBFD transceiver which shares single antenna for both Tx and Rx operation, an antenna with 40 dB interport isolation in addition to 30 dB SIC at each of analog and digital stages can be used to obtain 100 dB SIC in total for 50 MHz bandwidth. Conversely, an antenna with 70 dB port to port isolation can be used to obtain same amount of 100 dB SIC in 50 MHz bandwidth without using complex SIC techniques at analog stage. Such antenna plus digital domain SIC solution is very useful to realize IBFD transceiver with a greatly reduced complexity.

In a nutshell, the present system may include a double differential-fed dual-polarized 2.4 GHz, microstrip patch antenna (1) with extremely high interport isolation for shared antenna architecture based In-Band Full Duplex (IBFD) transceiver. The presented antenna (1) configuration is based on four ports linearly polarized single radiating element with differential feeding for both transmit (Tx) and receive (Rx) operation. The double differential feeding using two identical 3 dB/180° ring hybrid couplers (2) with nice amplitude and phase balance effectively suppresses the interport RF leakage to achieve very high isolation. According to a preferred embodiment, proposed antenna architecture is realized using 1.6 mm thick general-purpose FR-4 substrate. The implemented antenna provides more than 90 dB and 80 dB interport RF isolation for 20 MHz and 40 MHz bandwidths respectively in addition to more than 98 dB port to port peak isolation when measured inside anechoic chamber.

In one aspect, a single radiating square patch-based antenna (1) suitable for in-band full duplex (IBFD) transceivers for operation of self-interference suppression/mitigation to improve full-duplex communication efficiency at antenna stage is proposed.

In a further aspect, said in-band full duplex (IBFD) antenna (1) comprises four differential ports (4, 5, 7, 8) facilitating double-differential feeding thereof.

In a further aspect, said in-band full duplex (IBFD) antenna (1) further comprises two 3 dB/180° hybrid ring couplers (2) for self-interference cancellation (SIC).

In a further aspect, said in-band full duplex (IBFD) antenna (1) further comprises at least two λ/4 microstrip feed lines (11) for excitation of said ports.

In a further aspect, said antenna further comprises a direct connection between either of said two 3 dB/180° hybrid ring coupler(s) (2) and either opposite pair of said four differential ports (4, 5, 7, 8).

In a further aspect, said at least two λ/4 microstrip feed lines (11) supplying said direct connection is coplanarly realized on a unifying FR-4 PCB (13) structure, resulting in static configuration.

In a further aspect, said antenna (1) and one of said two 3 dB/180° hybrid ring coupler(s) (2) direct connections between which are supplied by said at least two λ/4 microstrip feed lines (11) are etched on the same FR-4 PCB (13) structure.

In a further aspect, said two 3 dB/180° hybrid ring coupler (2) etched on the same FR-4 PCB (4) structure is configured to supply Rx mode excitation.

In a further aspect, said two 3 dB/180° hybrid ring coupler (2) in non-coplanar relationship with said antenna (1) is configured to supply Tx mode excitation.

In a further aspect, said 3 dB/180° hybrid ring coupler (2) in non-coplanar relationship with said antenna (1) comprises connection with said antenna (1) using phase matching RF cables (12).

In a further aspect, said at least two λ/4 microstrip feed lines (11) for excitation of respective ports are 19 mm in length.

In a further aspect, said radiating square patch antenna (1) is 29 mm×29 mm in dimensions.

In a further aspect, an in-band full duplex (IBFD) transceiver comprising said double differential-fed dual-polarized single radiating square patch-based antenna (1) is proposed.

What is claimed is:

1. A system comprising:

a single radiating square patch-based in-band full duplex (IBFD) antenna suitable for in-band full duplex (IBFD) transceivers and configured for operation of self-interference suppression/mitigation to improve full-duplex communication efficiency at antenna stage;

said in-band full duplex (IBFD) antenna comprising four differential ports facilitating double-differential feeding thereof;

said in-band full duplex (IBFD) antenna further comprising two 3 dB/180° hybrid ring couplers for self-interference cancellation (SIC); and said in-band full duplex (IBFD) antenna further comprising at least two λ/4 microstrip feed lines for excitation of said differential ports.

2. system as set forth in claim 1, wherein said in-band full duplex (IBFD) antenna further comprises a direct connection between either of said two 3 dB/180° hybrid ring coupler(s) or either opposite pair of said four differential ports.

3. The system as set forth in claim 2, wherein said at least two λ/4 microstrip feed lines supplying said direct connection are coplanarly realized on a unifying flame retardant 4 (FR-4) printed circuit board (PCB) structure, resulting in a static configuration.

4. The system as set forth in claim 2, wherein said in-band full duplex (IBFD) antenna and one of said two 3 dB/180° hybrid ring coupler(s), direct connections between which are supplied by said at least two λ/4 microstrip feed lines, are etched on the same unifying flame retardant 4 (FR-4) printed circuit board (PCB) structure.

5. The system as set forth in claim 4, wherein said two 3 dB/180° hybrid ring coupler (2) etched on the same FR-4 PCB structure is configured to supply receiver (Rx) mode excitation.

6. The system as set forth in claim 1, wherein said two 3 dB/180° hybrid ring coupler, in non-coplanar relationship with said in-band full duplex (IBFD) antenna, is configured to supply transmit (Tx) mode excitation.

7. The system as set forth in claim 6, wherein said 3 dB/180° hybrid ring coupler, in non-coplanar relationship with said in-band full duplex (IBFD) antenna, comprises connection with said in-band full duplex (IBFD) antenna using phase matching radio frequency (RF) cables.

8. The system as set forth in claim 1, wherein said at least two λ/4 microstrip feed lines, for excitation of respective ports, are 19 mm in length.

9. The system as set forth in claim 1, wherein said radiating square patch antenna is 29 mm×29 mm in dimensions.

10. The system of claim 1, further comprising an in-band full duplex (IBFD) transceiver coupled with said double differential-fed dual-polarized single radiating square patch-based in-band full duplex (IBFD) antenna.

* * * * *